US007214054B2

(12) United States Patent
Boulachanis

(10) Patent No.: US 7,214,054 B2
(45) Date of Patent: May 8, 2007

(54) MAGIC CANDLES AND CANDLE BASES, MAGIC ADVERTISEMENT DISPLAYS

(76) Inventor: Nick Boulachanis, 3623 Souvenir, Laval, Quebec (CA) H7V 1X5

( * ) Notice: Subject to any disclaimer, the term of this patent is extended or adjusted under 35 U.S.C. 154(b) by 50 days.

(21) Appl. No.: 10/829,656

(22) Filed: Apr. 22, 2004

(65) Prior Publication Data

US 2004/0265763 A1 Dec. 30, 2004

(30) Foreign Application Priority Data

Apr. 22, 2003 (CA) ..... 2427461

(51) Int. Cl.
*F23D 3/16* (2006.01)
*F23Q 2/32* (2006.01)

(52) U.S. Cl. ..... 431/289; 431/126

(58) Field of Classification Search ..... 431/289, 431/288, 126, 320, 323, 298, 291; 248/511; 362/161; 220/560; *F21V 35/00*
See application file for complete search history.

(56) References Cited

U.S. PATENT DOCUMENTS 4,087,236 A * 5/1978 Gilmore ..... 431/290
4,096,298 A * 6/1978 Menig ..... 427/262
4,384,847 A * 5/1983 Schirneker ..... 431/291
4,529,376 A * 7/1985 Cafolla ..... 431/320
5,057,005 A * 10/1991 Kwok ..... 431/253
6,709,266 B2 * 3/2004 Jensen ..... 431/296
6,799,965 B1 * 10/2004 Gaudioso ..... 431/35
7,090,369 B1 * 8/2006 Jordan ..... 362/170
2003/0064338 A1 * 4/2003 Jensen ..... 431/297

* cited by examiner

*Primary Examiner*—Cheryl Tyler
*Assistant Examiner*—Michael J. Early

(57) ABSTRACT

In a first broad aspect, the invention provides an apparatus usable with a liquid. The apparatus includes a container for receiving the liquid and an object. The object is substantially buoyant and supportable by the liquid while being at least in part submerged into the liquid. A first magnet is mounted to the object, the first magnet defining first magnet first and second magnetic poles having opposed polarities. A second magnet is movable over a predetermined path relatively to the container. The second magnet defines second magnet first and second magnetic poles having opposed polarities. Moving the second magnet over the predetermined path modifies the magnetic fields present substantially adjacent the first magnet, thereby causing a force onto the object.

6 Claims, 15 Drawing Sheets

MAGIC CANDLES AND CANDLE BASES, MAGIC ADVERTISEMENT DISPLAYS

This application claims priority from Canadian Patent Application Serial Number 2,427,461 filed Apr. 22, 2003.

FIELD OF THE INVENTION

The present invention relates to the field of decoration. More specifically, the present invention is concerned with a decorative apparatus.

BACKGROUND OF THE INVENTION

Most objects used for to decorate are implements that do not include any moving part. However, the use of moving parts would enable to create aesthetic effects that are not achievable with devices or implements that do not include such moving parts.

In cases wherein a decorative apparatuses includes moving parts, the parts typically move with respect to each other through mechanical components that are actuated by a motor. However, in many cases, it is undesirable that such mechanical components be used as they are readily seen by the persons who are looking at the apparatus. Therefore, the source of movement is readily apparent, which may in some cases reduce the visual impact of the decorative apparatus.

In view of the above, there exists a need in the industry to provide a novel decorative apparatus.

An object of the present invention is therefore to provide an improved decorative apparatus.

SUMMARY OF THE INVENTION

In a first broad aspect, the invention provides an apparatus usable with a liquid. The apparatus includes a container for receiving the liquid and an object. The object is substantially buoyant and supportable by the liquid while being at least in part submerged into the liquid. A first magnet is mounted to the object, the first magnet defining first magnet first and second magnetic poles having opposed polarities. A second magnet is movable over a predetermined path relatively to the container. The second magnet defines second magnet first and second magnetic poles having opposed polarities. Moving the second magnet over the predetermined path modifies the magnetic fields present substantially adjacent the first magnet, thereby causing a force onto the object.

Advantageously, the apparatus is relatively easy to use and relatively easy and inexpensive to manufacture.

Moving the object through magnetic interactions creates a "magical" effect in that it creates the appearance of an object that moves with no external cause.

In some embodiments of the invention, the object may support a combustible light source, such as an oil lamp or a candle. In this embodiment of the invention, the water reflects at least in part the light emitted by the combustible light source, which also increases the aesthetics of the apparatus.

Another advantage of the present invention is that it is relatively easy to manufacture the apparatus such that is relatively quiet in operation. For example, this is performed by using an electrical motor for moving the second magnet and using relatively simple components to attach the second magnet to the motor, which eliminates the need to have noise-causing gears.

In another broad aspect the invention provides an apparatus usable with a liquid. The apparatus includes a container for receiving the liquid and an object, the object being substantially buoyant and supportable by the liquid while being at least in part submerged into the liquid. An actuator is operatively coupled to the object for moving the object relatively to the container.

Other objects, advantages and features of the present invention will become more apparent upon reading of the following non-restrictive description of preferred embodiments thereof, given by way of example only with reference to the accompanying drawings.

DETAILED DESCRIPTION

Figure 1:
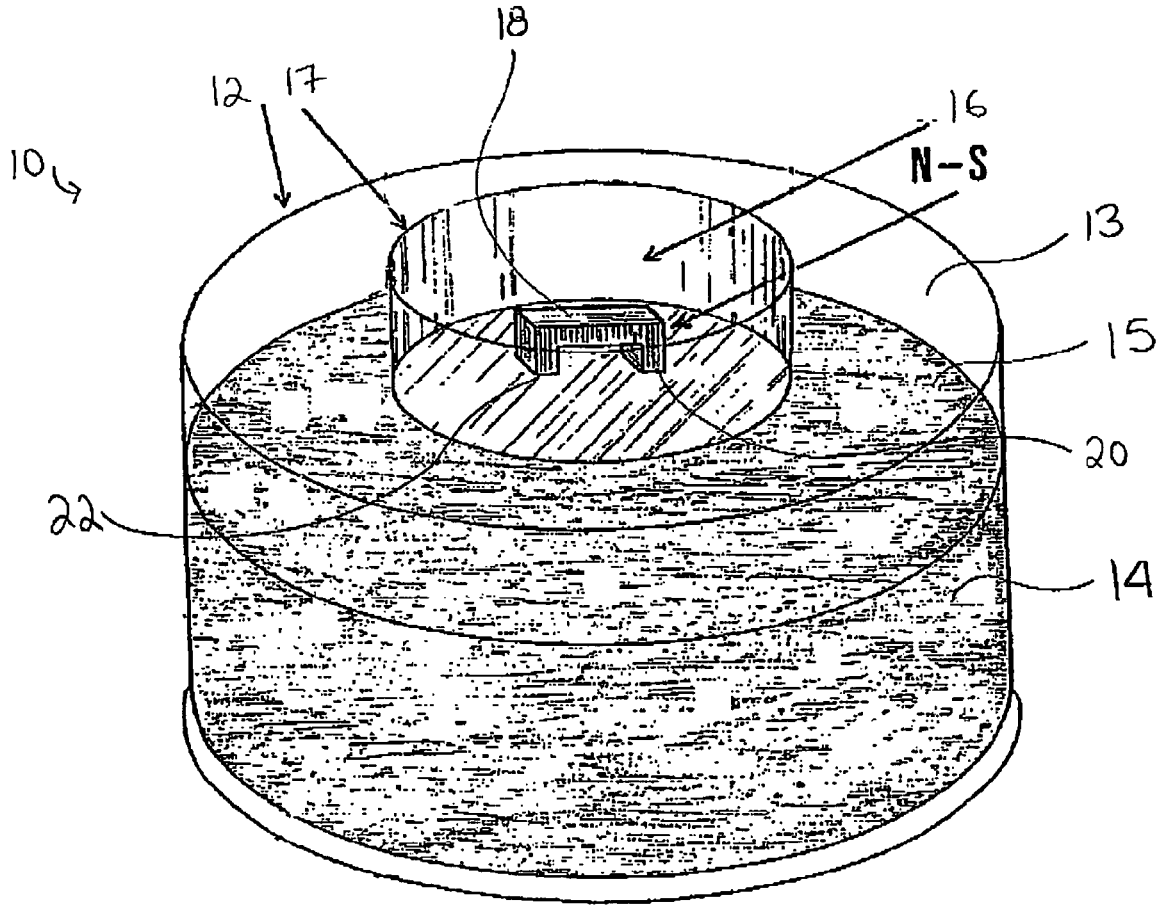
FIG. 1, in a perspective view, illustrates an apparatus in accordance with an embodiment of the present invention, the apparatus including a container filled with a liquid and an object supported by the liquid.
Figure 1:
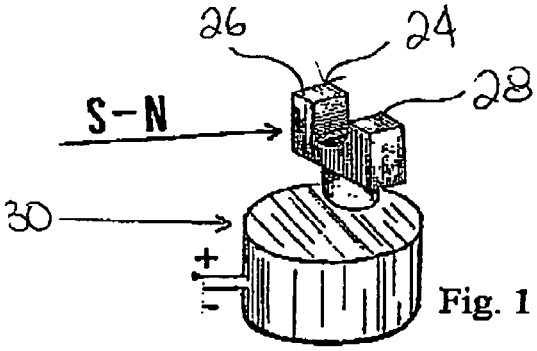
Figure 2:
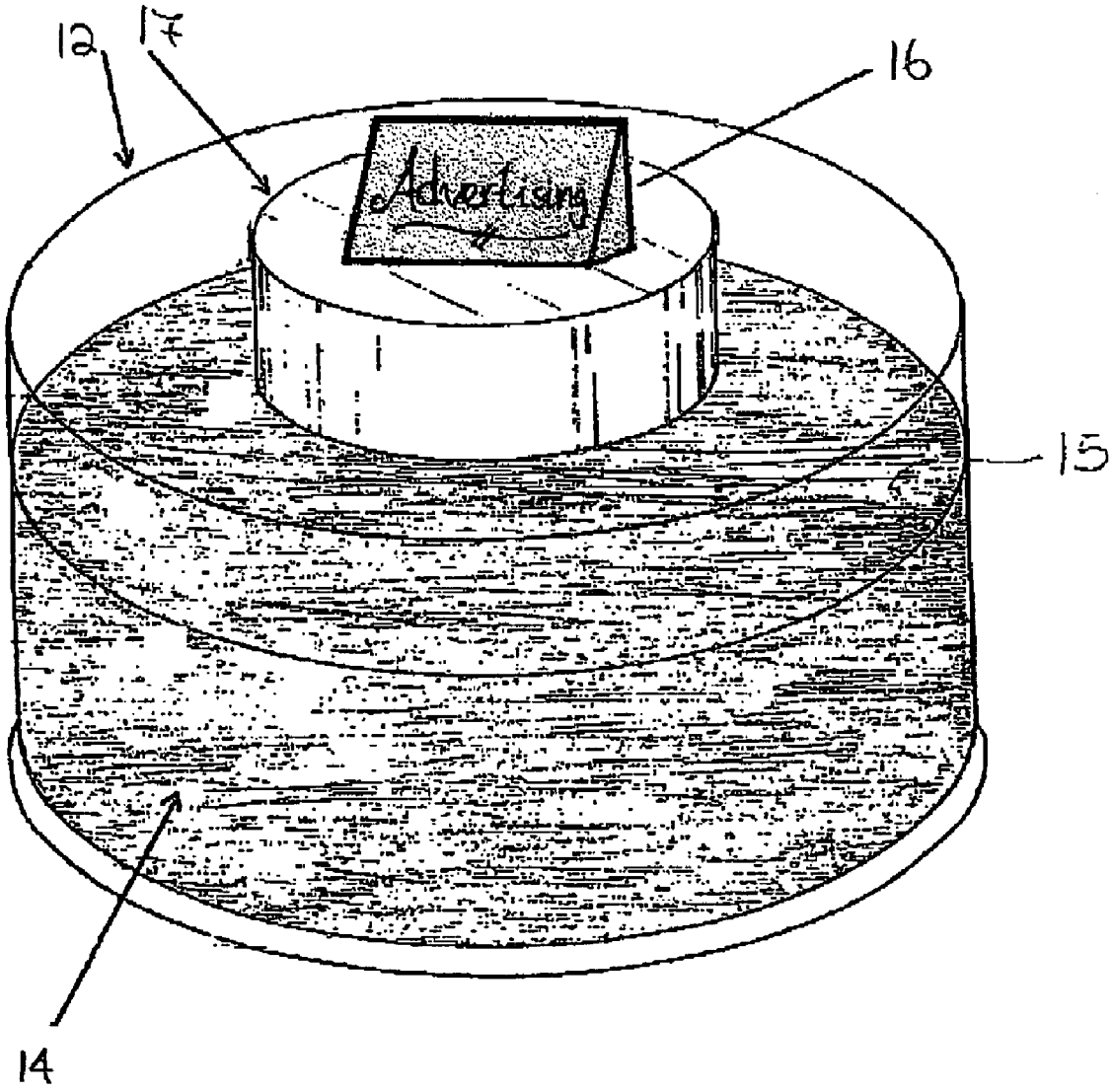
FIG. 2, in a perspective view, illustrates the container of FIG. 1.
Figure 3:
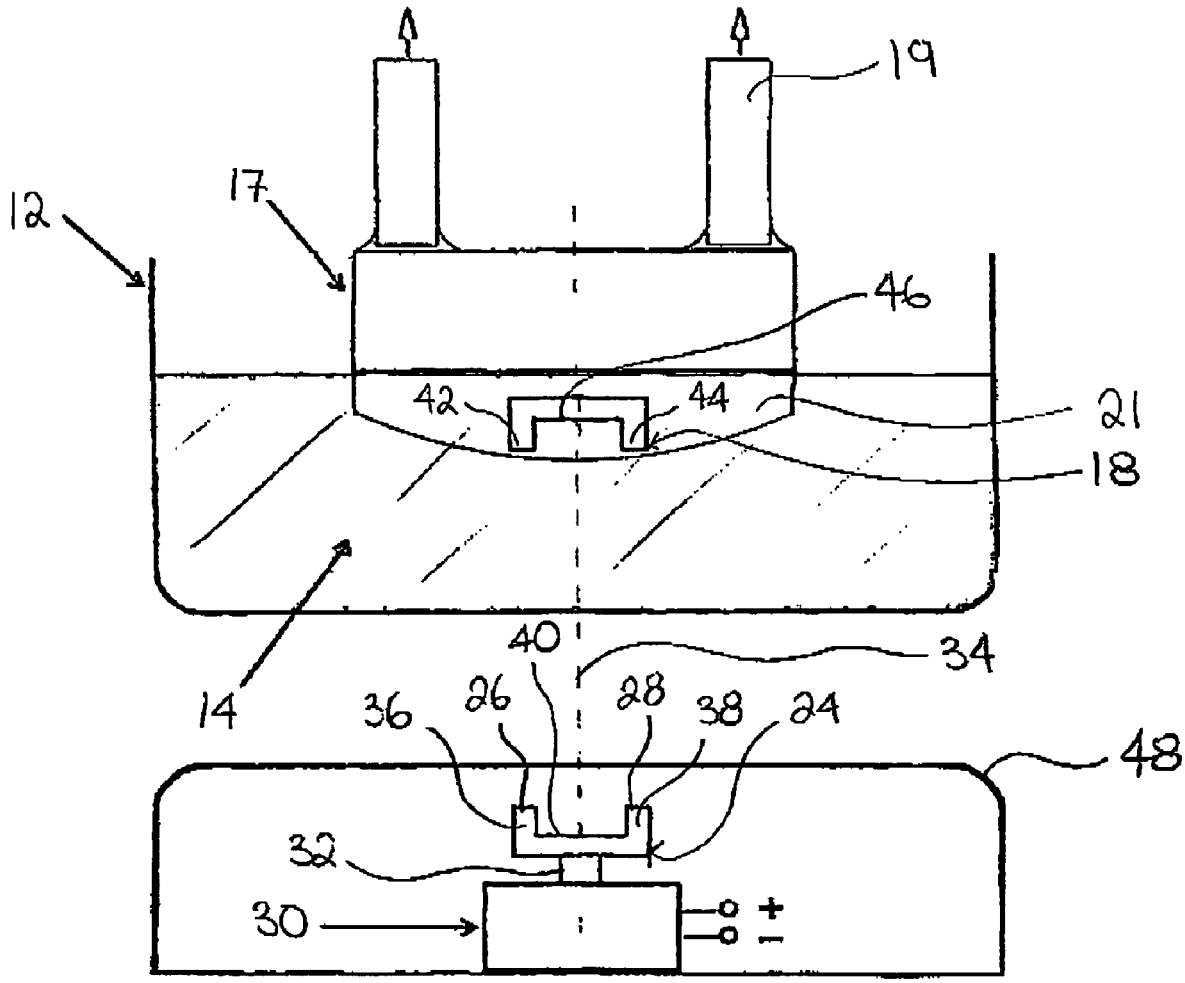
FIG. 3, in a side elevation cross-sectional view, illustrates the apparatus of FIG. 1 with the object supporting candles.

FIGS. 1 to 3 illustrate an apparatus 10 including a container 12 for receiving a noncombustible liquid 14. The apparatus 10 further includes an object 16, the object 16 being substantially buoyant and supportable by the liquid 14 while being at least in part submerged into the liquid 14. The liquid 14 is water, colored water or any other suitable non-combustible liquid. An actuator is operatively coupled to the object for moving the object 16 relative to the container 12.

The container 12, as seen in the drawings, is substantially cylindrical. However, as seen in other embodiments of the invention shown in other Figures, the container 12 may take any other suitable shape, such as for example, the shape of a half-sphere. Also, in some embodiments of the invention, the container 12 is made of substantially transparent or translucent material. For example, the container 12 may be made of glass, colored glass, or translucent plastic, among other possibilities.

In the embodiment of the invention shown in FIGS. 1 to 3, the container 12 is not closed and, therefore, defines a top aperture 13 through which the liquid 14 may be poured and through which the object 16 may be inserted. In this embodiment of the invention, the liquid 14 therefore defines a surface 15 onto which the object 16 floats.

The object 16 is partially submersible and floatable onto the liquid 14. In some embodiments of the invention, as seen in the drawings, the object 16 includes a top portion 17 and a submersible portion 21 extending substantially downwardly therefrom. The object 16 has a configuration, dimensions and density such that the top portion 17 is typically above the surface 15 while the submersible portion 21 is submerged into the liquid 14 when the object 12 floats onto the liquid 14. For example, and non-limitingly, the submersible portion 21 is substantially concave and, more specifically, may take the shape of a portion of a sphere. In this case, the top portion may be substantially cylindrical, for example.

In some embodiments of the invention, as seen in FIG. 2, the object 16 includes at least one of graphics and lettering inscribed thereonto. The graphics may be line-graphics or may consist of colored regions of the object 16 that produce a relatively pleasant aesthetic effect. The graphics, lettering or both may be also used for promotional purposes to advertise a brand, a product or a service, among other possibilities.

In some embodiments of the invention, as seen from FIG. 3, the apparatus 10 is usable with a combustible light source and the top portion 17 takes the form of a light source support for supporting the combustible light source above the liquid 14 in a conventional manner. For example, the combustible light source includes a candle 19, as seen in FIG. 3. In other embodiments of the invention, the combustible light source includes an oil lamp as described in further details hereinbelow.

Referring to FIG. 3, in some embodiments of the invention, the actuator includes a first magnet 18 and a second magnet 24. The first magnet 18 is mounted to the object 16 and defines first magnet first and second magnetic poles 20 and 22 having opposed polarities. For example, the first magnet 18 is mounted into the object 16 and hidden from view.

The second magnet 24 is movable over a predetermined path relatively to the container 12. The second magnet 24 defines second magnet first and second magnetic poles 26 and 28 having opposed polarities. The term "moving over a predetermined path" should be interpreted broadly and indicates either translational movements of the second magnet 24 relatively to the container 12, rotational movement of the magnet 20 relatively to the container 12, or combinations of rotational and translational movement of the second magnet 24 relatively to the container 12. In the embodiment of the invention shown in FIGS. 1 to 3, the second magnet 24 rotates relatively to the container 12, as described in further details hereinbelow.

In some embodiments of the invention, the second magnet 24 is movable over the predetermined path manually. However, in other embodiments of the invention, as shown in FIGS. 1 to 3, the second magnet 24 is movable by a motor 30 and a magnet support 32 rotatable by the motor 30 about a rotation axis 34. The second magnet 24 is mounted to the magnet support 32 so that at least one of the second magnet first and second magnetic poles 26 and 28 are located eccentrically relatively to the rotation axis 34.

In the embodiment of the invention shown in FIGS. 1 to 3, the second magnet 24 is mounted to the magnet support 32 so that both the second magnet first and second magnetic poles 26 and 28 are located substantially eccentrically relatively to the rotation axis 34. In this specific embodiment of the invention, the second magnet 24 is substantially U-shaped and defines a second magnet first leg 36, a second magnet second leg 38 and a second magnet legs connecting portion 40 extending therebetween.

The second magnet first magnetic pole 26 is located into the second magnet first leg 36 and the second magnet second magnetic pole 28 is located into the second magnet second leg 38. The second magnet 24 is attached to the magnet support 32 so that the second magnet first and second legs 36 and 38 are located substantially diametrically opposed to each other relatively to the rotation axis 34. In this embodiment of the invention, the support 32 takes the form of an axle substantially co-linear with the rotation axis 34 and rotated about its longitudinal axis by the motor 30.

Furthermore, the first magnet 18 is also substantially U-shaped and defines a first magnet first leg 42, a first magnet second leg 44 and a first magnet legs connecting portion 46 extending therebetween. The first magnet first magnetic pole 20 is located into the first magnet first leg 42 and the first magnet second magnetic pole 22 is located into the first magnet second leg 44. The first magnetic first and second legs 42 and 44 extend substantially towards the second magnet 24 when the object 16 is supported by the liquid 14. Furthermore, the second magnet first and second legs 26 and 28 extend substantially towards the first magnet 18.

In this embodiment of the invention, the first and second magnets 18 and 24 are aligned such that the first magnet first and second poles 20 and 22 face the second magnet first and second magnetic poles 26 and 28 in a manner such that poles having opposed polarities in different magnets face each other. This alignment is typically achieved spontaneously when the object 16 is first put in the liquid 14.

As shown in the drawings, in the apparatus 10, the first magnet 18 is mounted into the object 16 at a location substantially central in radial direction. Also, the candies 19 are supported by the object 16 at locations substantially radially peripheral onto the object 16.

In some embodiments of the invention, the motor 30 and the second magnet 24 are mounted into a motor casing 48 that hides the motor 30 and the second magnet 24 from view. The container 12 is supported by a container support (not shown in FIGS. 1 to 3) for suspending the container 12 spaced apart from the motor casing 48.

Typically, the object 16, the container 12 and the motor casing 48 are made of a non-magnetic material so that they do not interfere with the attraction between the first and second magnets 18 and 24. For example, the object 16 may be made of plastic, a non-magnetic metal, cork or Styrofoam™, among other possibilities. Also, in some embodiments of the invention, the object 16 is an inflatable object.

In use, the liquid 14 is poured into the container 12 and the container 12 is positioned above the motor casing 48. Then, the motor 30 is energized so that the magnet support 32 rotates about the rotation axis 34, which in turn rotates the second magnet 24. Since the second magnet first and second magnetic poles 26 and 28 move, the magnetic field present substantially adjacent the first magnet 18 is modified, which causes a magnetic force onto the first magnet 18 and consequently causes a force to be exerted onto the object 16. In this case, the object 16 rotates about its center, which causes the candles 19 to move in a substantially circular path above the liquid 14 in a plane substantially parallel to the surface 15 of the liquid 14.

Figure 4:
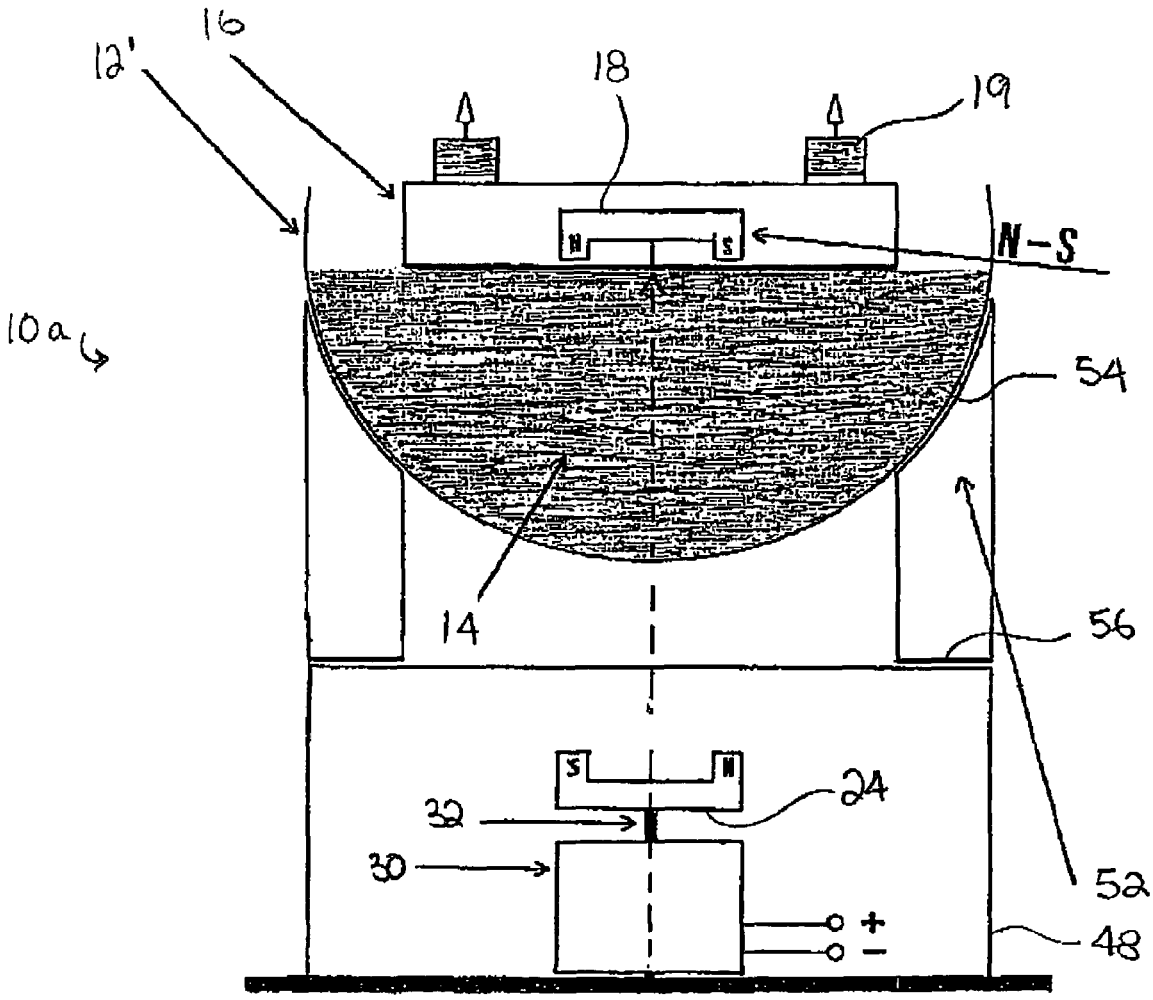
FIG. 4, in a side elevation cross-sectional view, illustrates an apparatus in accordance with an alternative embodiment of the present invention.
Figure 6:
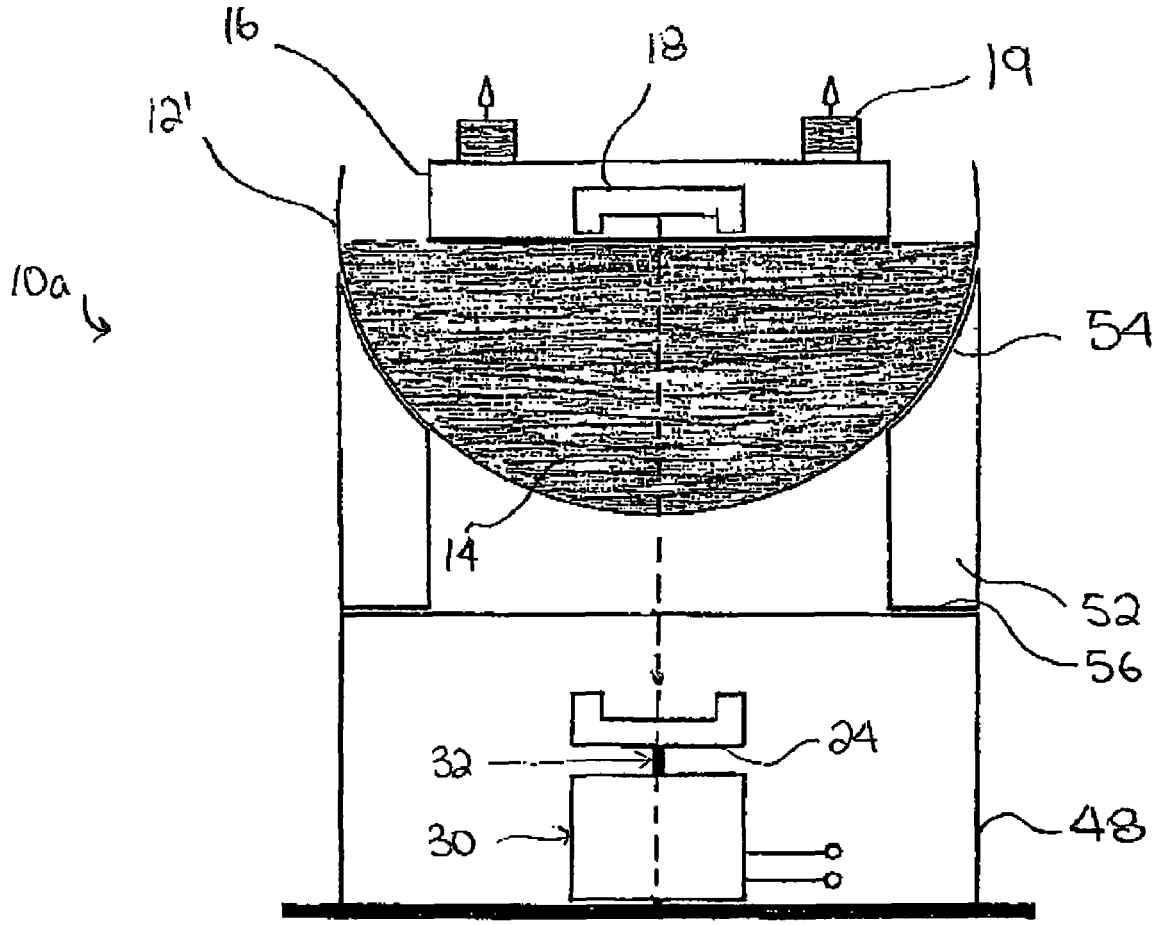
FIG. 6, in a side elevation cross-sectional view, illustrates the apparatus of FIG. 4.
Figure 7:
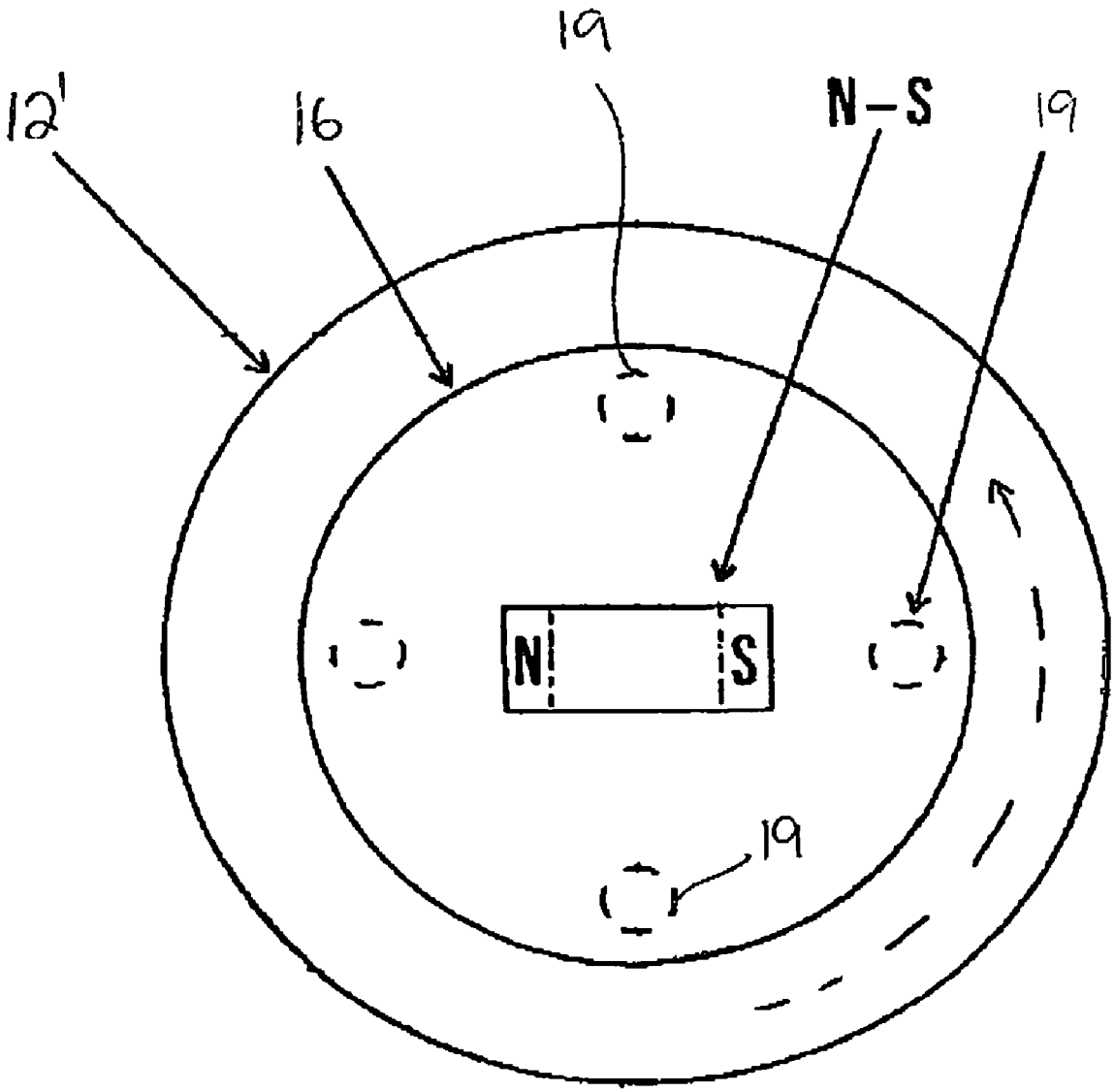
FIG. 7, in a bottom plan view, illustrates the container and object of the apparatus of FIG. 4.

FIGS. 4, 6 and 7 illustrate an alternative embodiment of the invention wherein an apparatus 10*a* includes a container 12' having the shape of a half-sphere. In these embodiments of the invention, the container 12' might be supported spaced apart from the motor casing through a bowl support 52. For example, the bowl support 52 has an upper surface 54 that conforms substantially to the shape of the container 12' and a bottom surface 56 that engages and is supported by the motor casing 48.

For example, the bowl support 52 includes a plurality of pillars circumferentially spaced apart from each other relatively to the container 12'. In another example, the bowl support 52 is substantially annular.

As shown in FIG. 7, the object 16 may support four candles 19 at substantially identically spaced angular locations substantially adjacent the periphery of the object 16.

Figure 5:
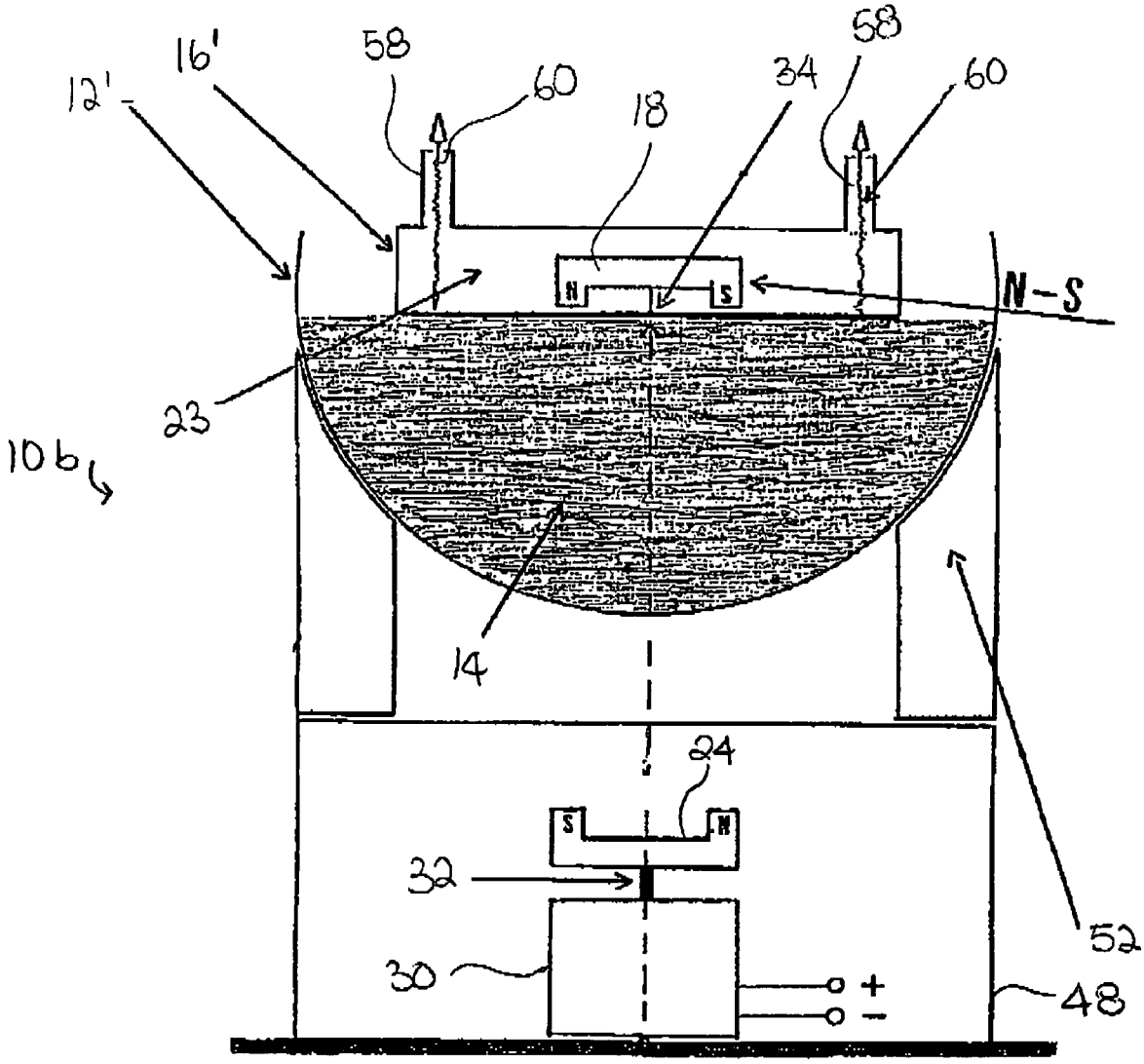
FIG. 5, in a side elevation cross-sectional view, illustrates an apparatus in accordance with another alternative embodiment of the present invention.

FIG. 5 illustrates yet another embodiment of the invention wherein an apparatus 10*b* includes the container 12' and an alternative object 16'. The object 16' includes a cavity 23 for receiving oil thereinto and two oil lamps 58 extending substantially upwardly therefrom substantially at the periphery thereof. The oil lamps each include a respective wick 60 for conducting the oil towards the surface of the oil lamps 58 wherein the oil may be burned.

Figure 8:
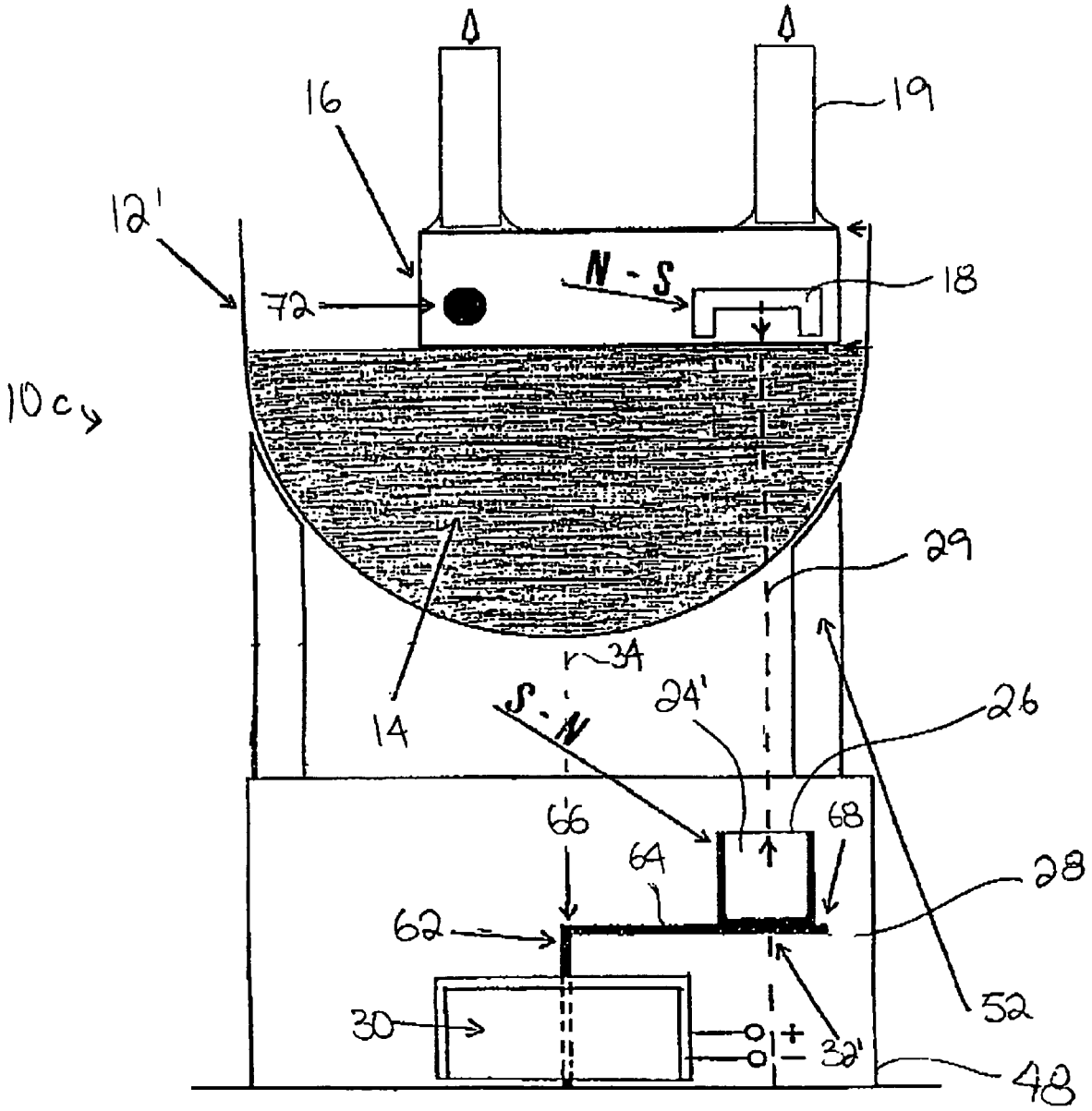
FIG. 8, in a side elevation cross-sectional view, illustrates an apparatus in accordance with yet another alternative embodiment of the present invention.
Figure 9:
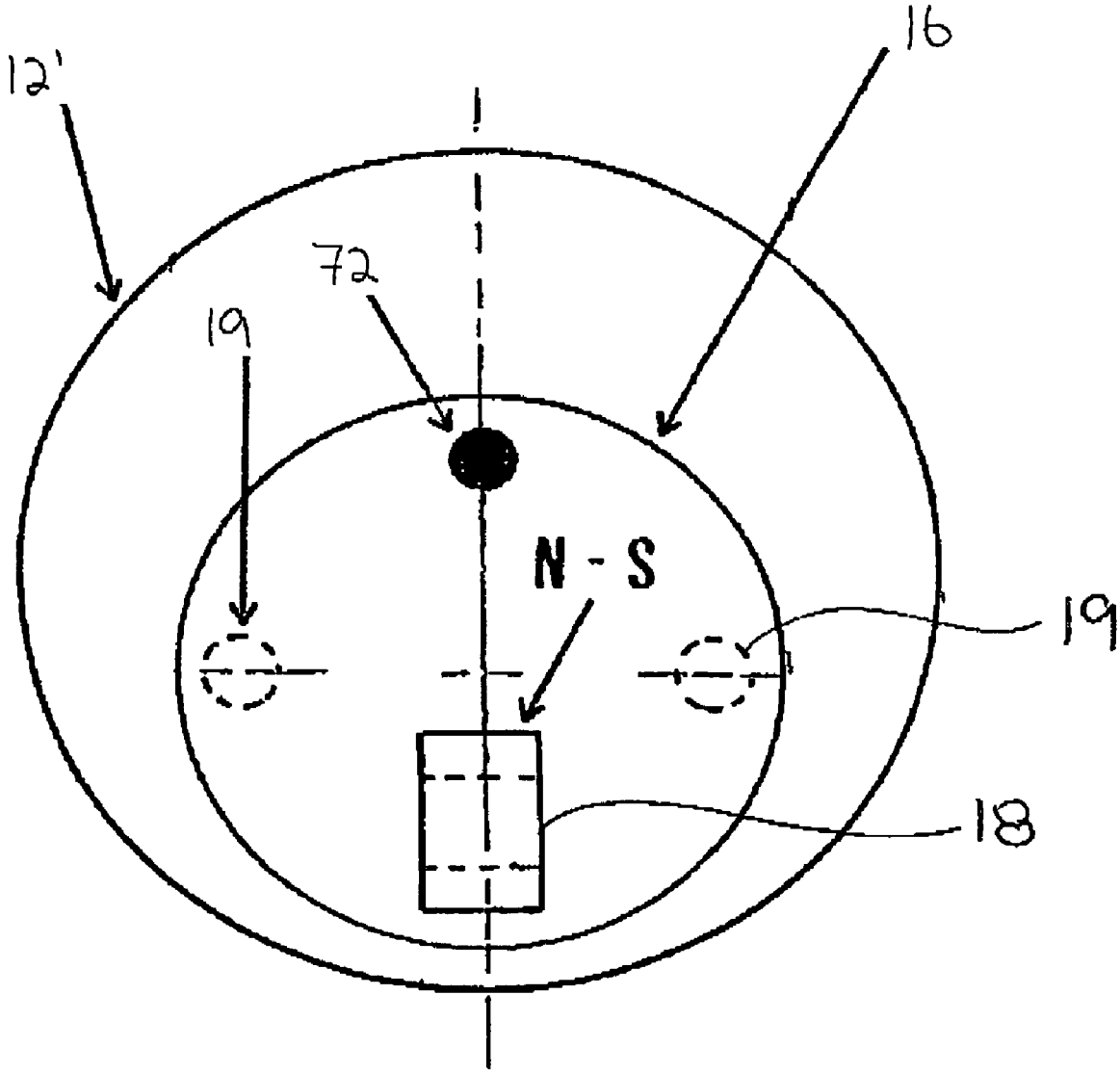
FIG. 9, in a top plan view, illustrates the apparatus of FIG. 8.

FIGS. 8 and 9 illustrate an alternative embodiment of the invention wherein an apparatus 10*c* includes an alternative magnet support 32'. The magnet support 32' includes an axle 62 and a substantially elongated support member 64 defining a magnet support first end 66 and a magnet support second end 68 substantially longitudinally opposed to the magnet support first end 66.

The magnet support first end 66 is located substantially adjacent the rotation axis 34 and a second magnet 24' is attached to the magnet support substantially adjacent the magnet support second end 68. In this embodiment of the invention, the second magnet 24' is an alternative second magnet 24' that is substantially elongated and has substantially longitudinally opposed magnet first and second magnetic poles 26 and 28. The second magnet 24' defines a second magnet longitudinal axis 29 that is substantially parallel to the rotation axis 34.

Also, in this embodiment of the invention, the first magnet 18 is located substantially eccentrically relatively to the object 16 and a counter-weight 72 is added so that the object 16 is floatable substantially horizontally onto the liquid 14.

In this embodiment of the invention, operating the motor 30 causes the second magnet 24' to move in a substantially circular path inside the motor casing 48. In turn, this causes forces onto the first magnet 18 that move the object 16 in a substantially circular path.

Figure 10:
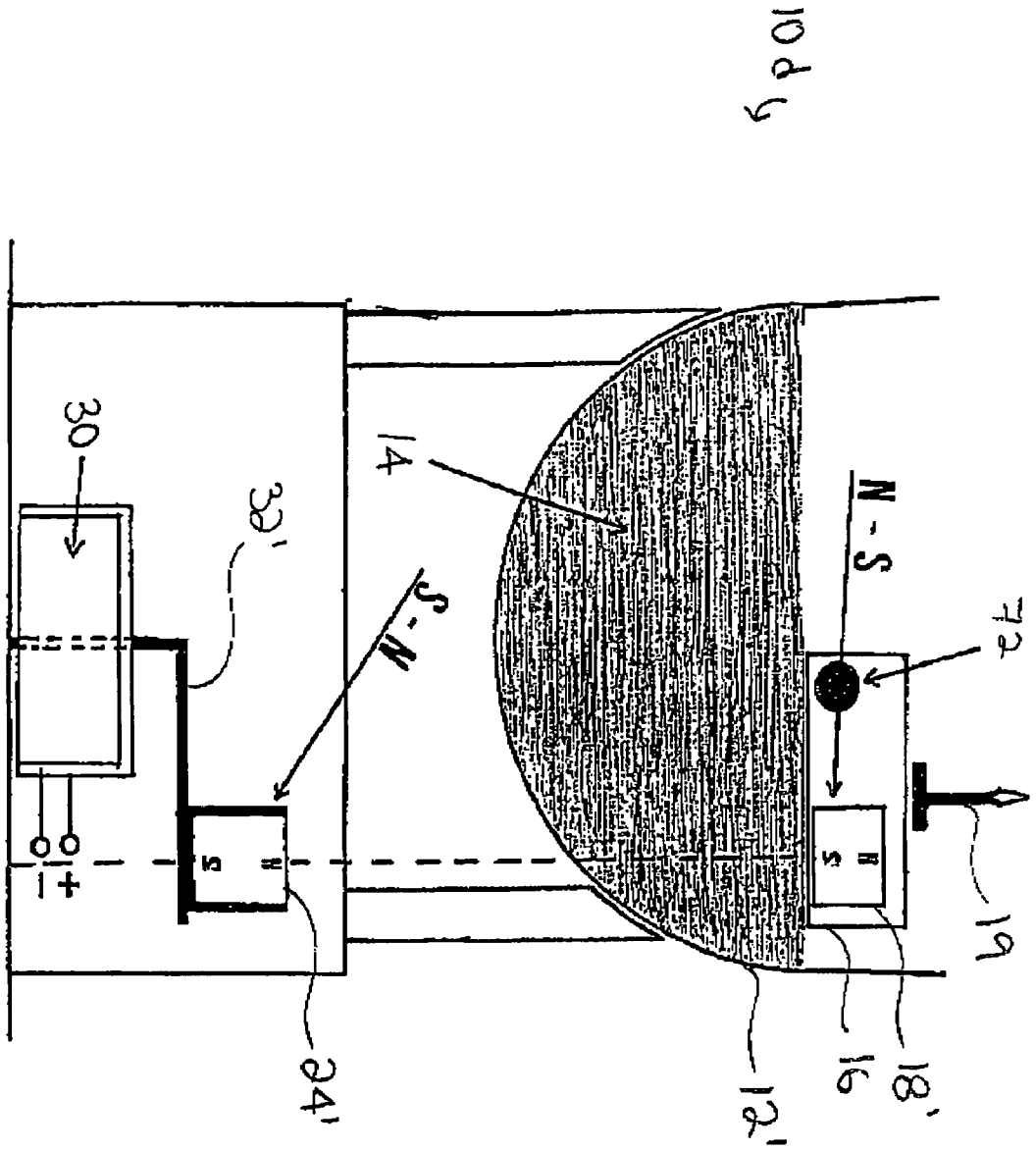
FIG. 10, in a side elevation cross-sectional view, illustrates an apparatus in accordance with yet another embodiment of the present invention.

FIG. 10 illustrates another embodiment 10*d* of the present invention wherein the first magnet is an alternative first magnet 181 that is also a substantially elongated magnet.

Figure 11:
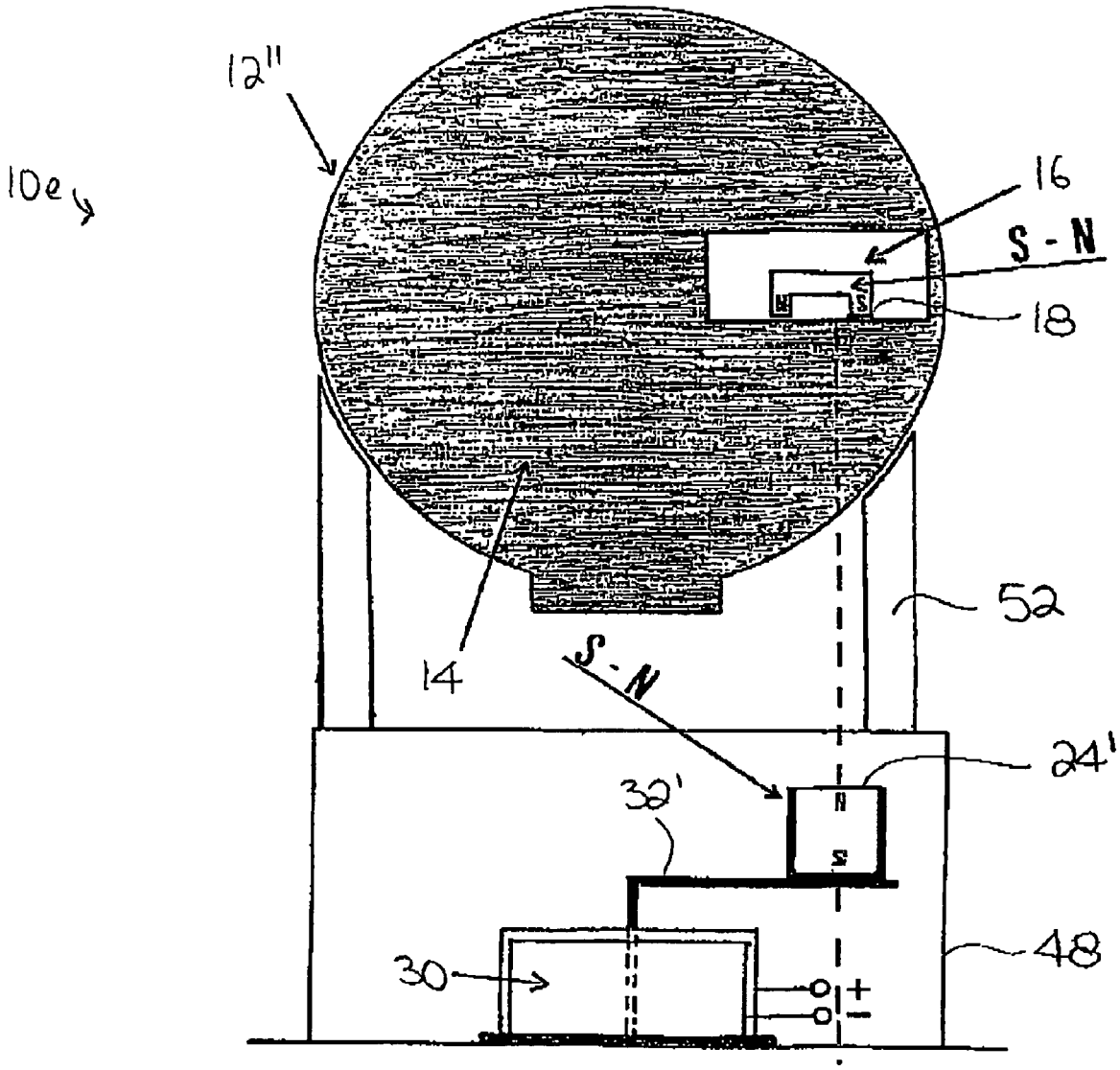
FIG. 11, in a side elevation cross-sectional view, illustrates an apparatus in accordance with yet another embodiment of the present invention.
Figure 12:
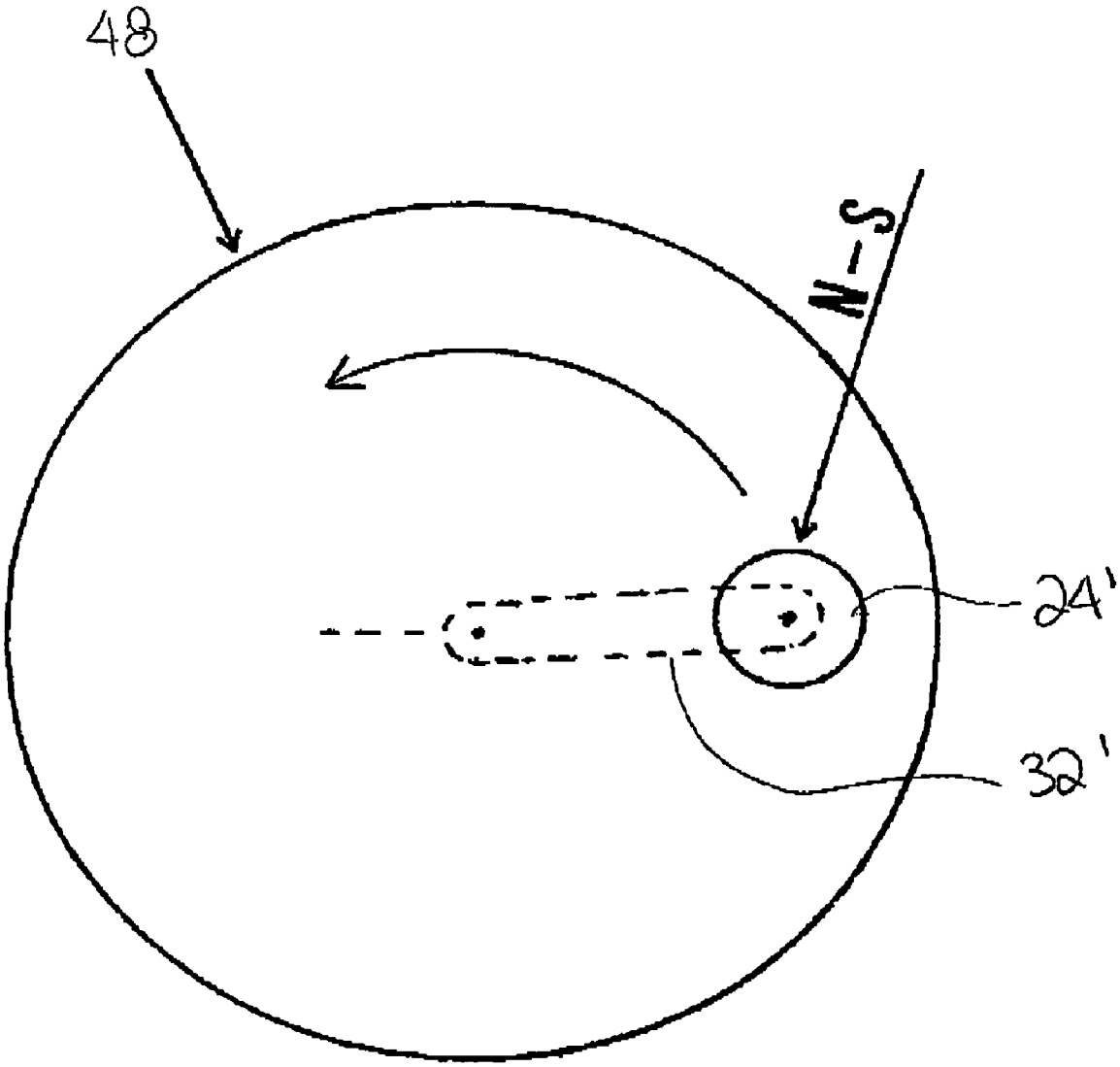
FIG. 12, in a partial top elevation view, illustrates the apparatus of FIG. 11.

FIGS. 11 and 12 illustrate another alternative apparatus 10*e* wherein the object 16 is entirely submersible into the liquid 14. In the apparatus seen in FIGS. 11 and 12, the object 16 therefore does not support a combustible light source. The specific weight of the object 16 is such that a balance between the magnetic force exerted by the second magnet 24' onto the first magnet 18 in a direction substantially longitudinally with respect to the second magnet 24' is balanced by the buoyancy of the object 16. In this embodiment of the invention, the container 12''' is a substantially hermetically sealable enclosure fillable with the liquid.

For example the container 12''' of the apparatus 10*e* is substantially spherical. In some embodiment of the invention, the spherical container has a diameter that is substantially equal to the distance between the rotation axis 34 and the second magnet 24'. Then, if the object 16 is positioned at an intermediate location between the top and bottom ends of the container, and if the buoyancy of the object 16 is suitable, the container 12'' stabilizes the object 16'' such that it remains at a substantially constant distance from the second magnet 24'.

Figure 13:
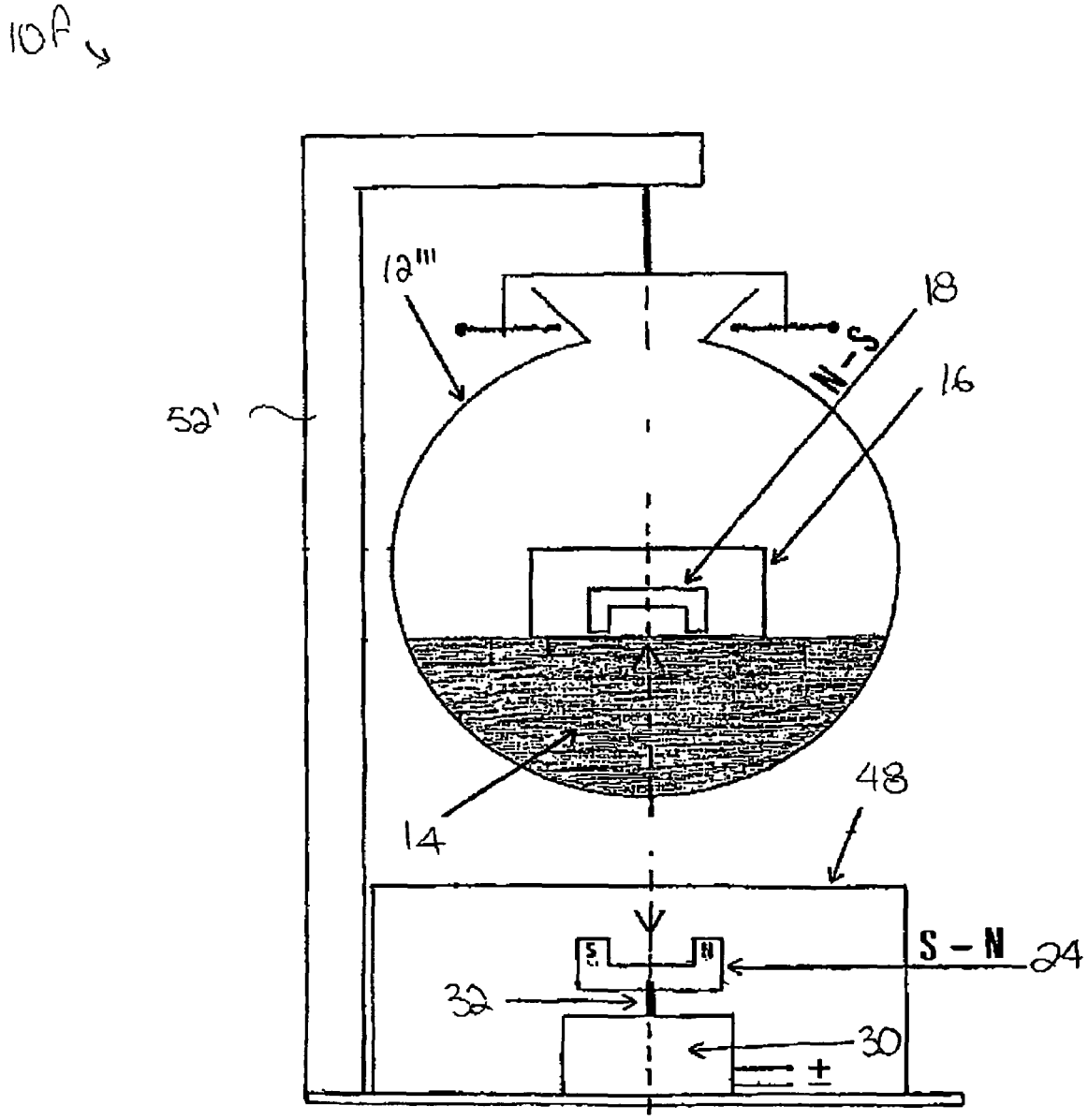
FIG. 13, in a side elevation cross-sectional view, illustrates an apparatus in accordance with yet another embodiment of the present invention.
Figure 14:
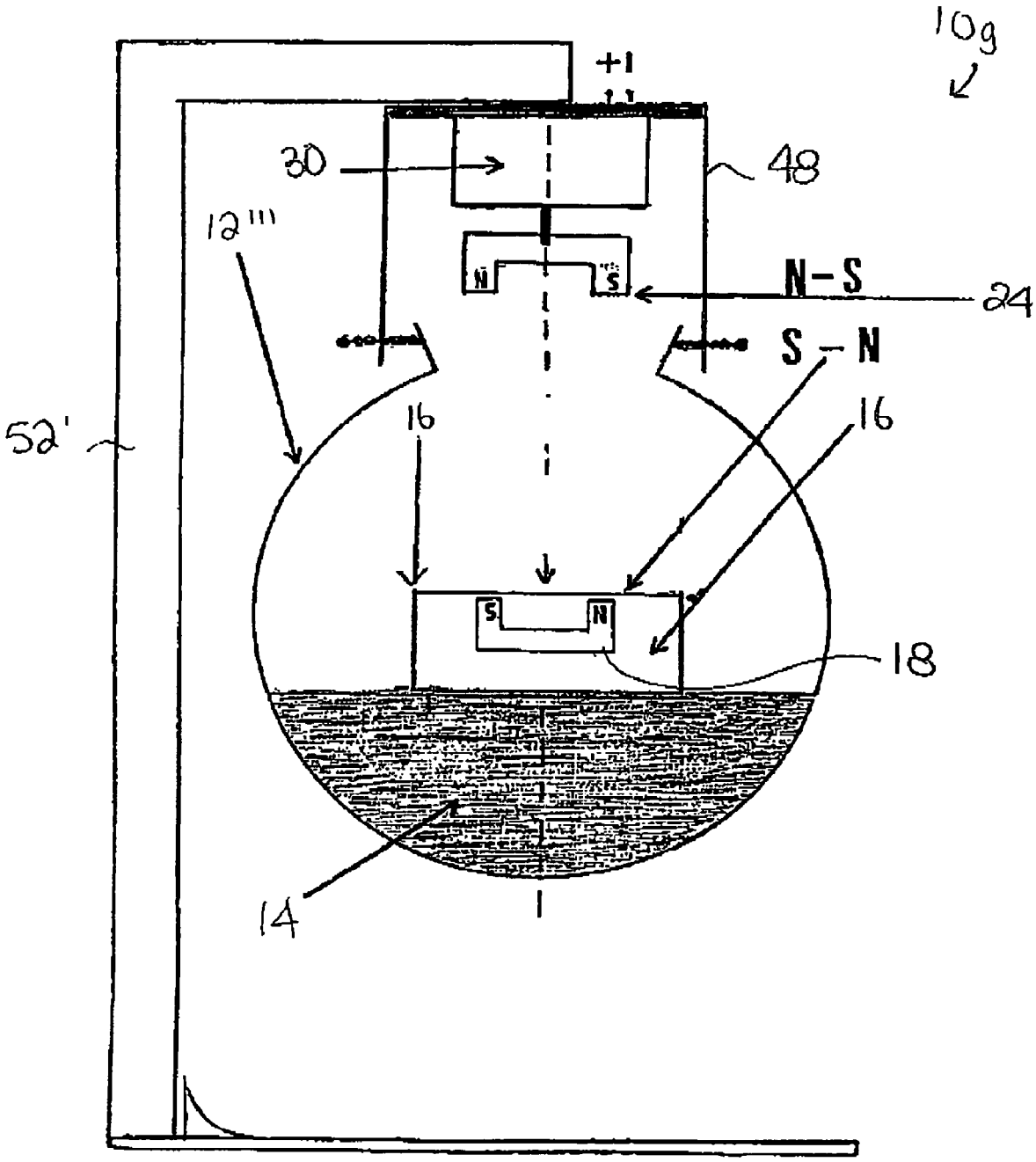
FIG. 14, in a side elevation cross-sectional view, illustrates an apparatus in accordance with yet another embodiment of the present invention.

FIGS. 13 and 14 illustrate yet other embodiments of the invention wherein apparatuses 10*f* and 10*g* include a container 12''' that is suspended from a top portion thereof through a substantially jib-shaped container support 52'. The motor 30, magnet support 32 and second magnet 24 may be located either below the container 12''' or above the container 12'''.

Figure 15:
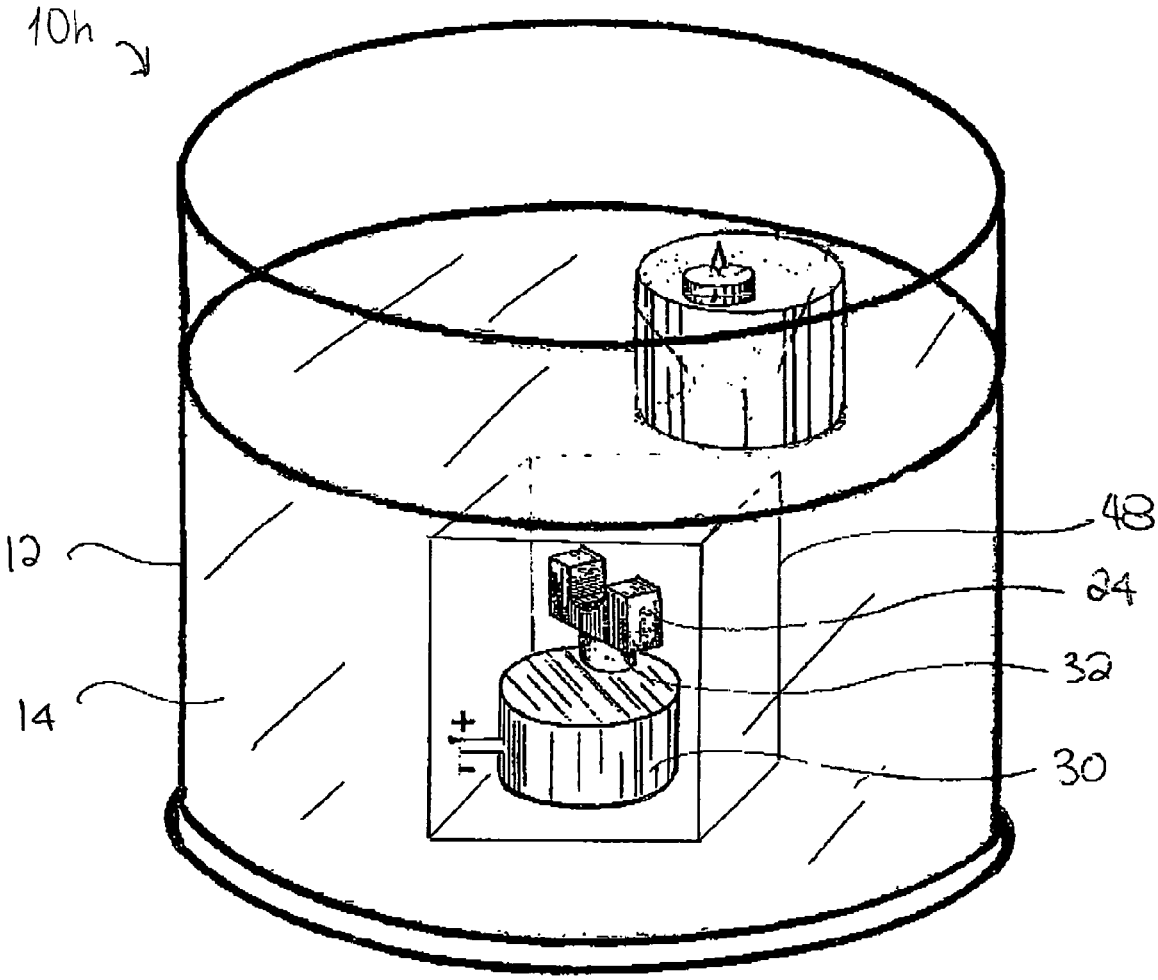
FIG. 15, in a perspective view, illustrates an apparatus in accordance with yet another embodiment of the present invention.

FIG. 15 illustrates yet another apparatus 10*h* wherein the motor 30, magnet support 32, second magnet 24 and motor casing 48 are located at the bottom of the container 12, into the liquid 14.

While the embodiments of the invention shown in the drawings include two magnets, it is within the scope of the present invention to replace one of the magnets with a magnetizable member. The magnetizable member is magnetized by the magnet and therefore allows to create the magnetic interaction between the magnet and the magnetizable member that allows moving the object 14. Also, in some embodiments of the invention, at least one of the first and second magnets may be either a permanent magnet or an electro-magnet.

In other embodiments of the invention, the apparatus is decorated, for example with flowers, lighting or colors. Also, it is within the scope of the invention to use the above-described apparatuses with a candle illumination device including a variable color light source, such as the device described in U.S. Pat. No. 3,762,857 issued to Andeweg on Oct. 2, 1973.

Although the present invention has been described hereinabove by way of preferred embodiments thereof, it can be modified, without departing from the spirit and nature of the subject invention as defined in the appended claims.

The invention claimed is:

1. A decorative apparatus usable with a liquid, said decorative apparatus comprising:

a container for receiving the liquid;

an object, said object being substantially buoyant and supportable by the liquid while being at least in part submerged into the liquid;

a first magnet mounted to said object, said first magnet defining first magnet first and second magnetic poles having opposed polarities;

a bundle of lit candles selected from the group consisting of wax candles oil candles and gel candles, placed on the surface of said object, and said object includes a support for supporting said bundle of lit candles above the liquid;

a second magnet movable over a predetermined path relatively to said container, said second magnet defining second magnet first and second magnetic poles having opposed polarities;

a motor and a magnet support, rotatable by said motor about a rotation axis, said second magnet being mounted to said magnet support so that at least one of said second magnet first and second magnetic poles is located eccentrically relatively to said rotation axis;

whereby said motor moves said second magnet over said predetermined path modifying a magnetic field present substantially adjacent said first magnet, thereby causing a force onto said object, thereby causing said object and said bundle of lit candles to move in guided circular motions.

2. A decorative apparatus as defined in claim 1, wherein said object is partially submersible and floatable onto the liquid.

3. A decorative apparatus usable with a non-combustible liquid, said decorative apparatus comprising, a container for receiving the liquid; a floatable candle supportable by the liquid, said floatable candle comprised of an open-top housing with a fuel inside and a wick in the fuel; a first magnet mounted to the base of said floatable candle, said first magnet defining first magnet first and second magnetic poles having opposed polarities; a second magnet movable over a predetermined path relatively to said container, said second magnet defining second magnet first and second magnetic poles having opposed polarities; a motor and a magnet support, rotatable by said motor about a rotation axis, said second magnet being mounted to said magnet support so that at least one of said second magnet first and second magnetic poles is located eccentrically relatively to said rotation axis; whereby said motor rotates said magnet support and said second magnet over said predetermined path modifying a magnetic field present substantially adjacent said first magnet, thereby rotating said floatable candle.

4. A decorative apparatus as defined in claim 1, wherein said first magnet is mounted into said object.

5. A decorative apparatus as defined in claim 1, further comprising a motor casing, said motor, magnet support and second magnet being mounted into said motor casing.

6. A decorative apparatus as defined in claim 1, further comprising a container support for suspending said container.

* * * * *